US005660061A

United States Patent [19]

Magida

[11] Patent Number: 5,660,061

[45] Date of Patent: Aug. 26, 1997

[54] SINGLE POST EARRING WITH MULTIPLE EARRING LOOK

[75] Inventor: Sara Magida, Great Neck, N.Y.

[73] Assignee: Almond International, Inc., Westbury, N.Y.

[21] Appl. No.: 653,440

[22] Filed: May 24, 1996

[51] Int. Cl.[6] ..... A44C 7/00

[52] U.S. Cl. ..... 63/12; 63/13

[58] Field of Search ..... 63/12, 13, 1.1, 63/2

[56] References Cited

U.S. PATENT DOCUMENTS 5,161,391 11/1992 Lorberfeld .

*Primary Examiner*—Kien T. Nguyen

*Attorney, Agent, or Firm*—Notaro & Michalos PC

[57] ABSTRACT

An earring which utilizes a single hole in a once pierced ear appears to be multiple earrings extending through multiple holes in the pierced ear. The earring includes a plurality of elongated open loops, each having a first end and second end. The first ends are advantageously and line a common plane. They are spaced apart to simulate the first ends of multiple loops extending to multiple holes in the ear. The opposite second ends are attached to each other for mutual support. Only one post extends from one of the first ends and through the once pierced ear.

19 Claims, 3 Drawing Sheets

SINGLE POST EARRING WITH MULTIPLE EARRING LOOK

FIELD AND BACKGROUND OF THE INVENTION

The present invention relates in general to jewelry, and in particular to a new and useful earring which has a single post for a pierced ear, but which when worn, looks as if the wearer is wearing multiple earrings which are each attached by separate posts to a separate hole in the pierced ear.

Earrings manufactured for pierced ear are widely known. The earring always include a single post which is elongated and of relatively small diameter so that it can be moved through the pierced ear, with the opposite end projecting beyond the ear. The post can either be curved, so that it is retained in the ear solely by virtue of the shape of the post, or relatively straight and held on the ear with a stud.

U.S. Design Patents Des. 334,004, Des. 334,010 and Des. 334,153, disclose earrings which have multiple loops and which can be held to an ear by a single post through a single hole in the pierced ear. Due to the placement and structure of the multiple loops and additional parts of the earring, there is no illusion that any more than a single post is used or needed to hold the earring to the ear.

It has become fashionable to wear more than one earring in a single ear. This generally involves piercing the ear a number of times equal to the number of earrings so that the wearer may pierce the ear 2, 3, 4 or even more times, to wear a corresponding number of earrings.

SUMMARY OF THE INVENTION

An object of the present invention is to provide a single earring which utilizes a single post for use in a single hole in a pierced ear, but which appears to be multiple earrings extending side-by-side on the ear. The observer would assume that a separate post is used on each separate earring, with each post extending through its own pierced hole in the ear.

With the present invention, individuals with ears which were pierced only once will appear to be wearing earrings mounted by multiple piercing through the ear.

Accordingly, an object of the present invention is to provide an earring for engaging a single hole in a once-pierced ear, but which looks like multiple earrings held by multiple holes in a multiply-pierced ear, comprising a plurality of elongated open loops, each having a first end and a second end, the first ends of all the open loops lying in a common plane, the first ends all being spaced from each other and extending in a sequence for lying on an outer surface of the once-pierced ear when the earring is worn. The second ends of the open loops are connected to each other for mutual support. The loops are shaped so that the second ends extend toward in inner surface of the ear to be hidden by the ear when the earring is worn. A single post is fixed to and extending outwardly from only one of the first ends, and for extending into the hole of the once-pierced ear supports all of the open loops.

A further object of the present invention is to provide an earring which permit a wearer to wear a style that appears to involve multiple earrings extending in multiple holes in the ear, but which only requires the wearer to have a single hole in the ear. This reduces the discomfort and danger of infection due to multiple piercing.

The present invention is also much easier to put on since only a single post must be pushed through a single hole and may be held either by the curved shaped of the post or by a stud. This also saves material in the earring since only a single post is required, with only a single stud, when a stud is needed.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENT

Figure 1:
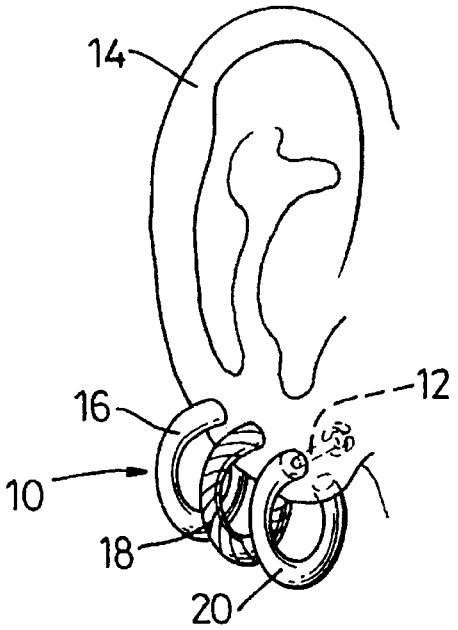
FIG. 1 is a perspective view of the invention worn on a once-pierced ear.
Figure 2:
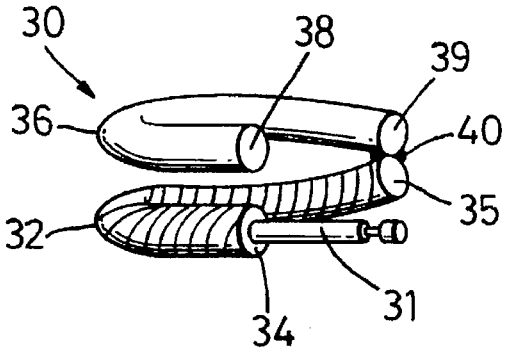
FIG. 2 is a top plan view of a second embodiment of the invention.

Referring to the drawings in particular, the invention embodied in FIG. 1 comprises a single earring general designated 10 which has a single post 12 that extends into the single hole of a once-pierced ear 14, but which appears to be multiple earrings made up of multiple open loops 16, 18 and 20. As shown in FIG. 2, which illustrates a second embodiment of the invention, this illusion is achieved by making the earring, there general designated 30, of a plurality of open loops 32 and 36 which each have first ends 34 and 38 which lay in a common plane corresponding to the outer surface of the ear, when the earring is worn. Each of the elongated open loops also include opposite second ends 35 and 39 which are connected to each other, for example, by solder 40, and which extend toward an inner surface of the ear so that the second ends 35, 39 are hidden by the ear when the earring us worn. FIGS. 1 and 2 also illustrate how the first ends of the loops are spaced from each other along the outer surface of the once-pierced ear, to further the illusion.

Figure 5:
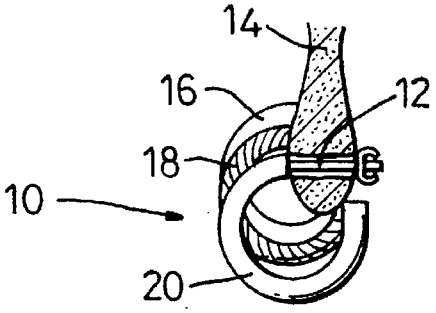
FIG. 5 is a side, partially sectional view of the embodiment of FIG. 1.
Figure 6:
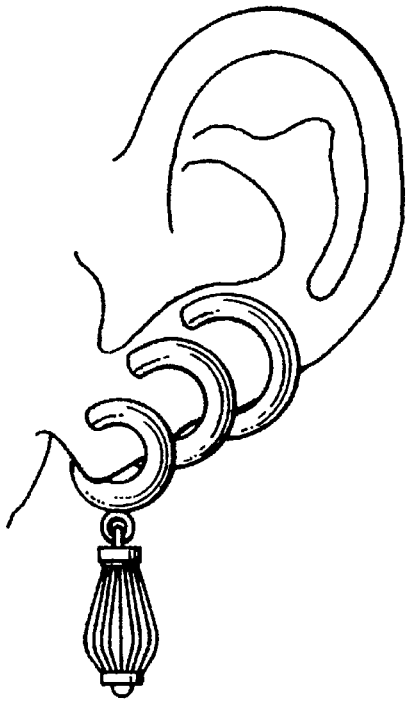
FIG. 6 is a view similar to FIG. 1 of a further embodiment of the invention.

FIG. 5 shows once-pierced ear 14 in sectional view with the single hole for receiving the post 12 of the lower most loop 20. FIG. 5 illustrates how each of the open loops, have an arch of at least 270° to ensure that all loops extend around to the inner surface of the ear to maximize the illusion. This is also the case whether the loop is circular, as illustrated in FIG. 2, somewhat oval, as illustrated in FIG. 1 or polygonal as illustrated in FIG. 3.

Figure 3:
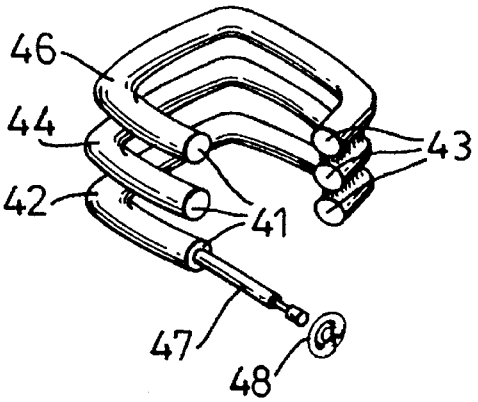
FIG. 3 is an exploded view of a third embodiment of the invention.
Figure 4:
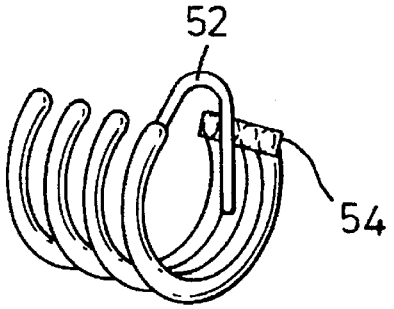
FIG. 4 is a perspective view of another embodiment of the invention.

Only a single post shown at 31 in FIG. 2 extends from the first end 34 of only one of the loops and may either be of the type which uses a stud as shown in FIG. 3, or the type which is bent so that by virtue of its shape it is held to the ear, as shown in post 52 in FIG. 4.

FIG. 3 illustrates another embodiment of the invention where the open loops 42, 44 and 46 are in the form of rounded polygons. As with all the embodiments of the invention, the first ends shown by the single reference numeral 41 lay in a common plane and are even advantageously flat, the ends being spaced from each other and laying in sequence, preferably in a straight line in the common plane. Only one of the ends carries the post 47 which can be pushed through the once-pierced ear and held by a stud 48 of conventional design.

Figure 7:
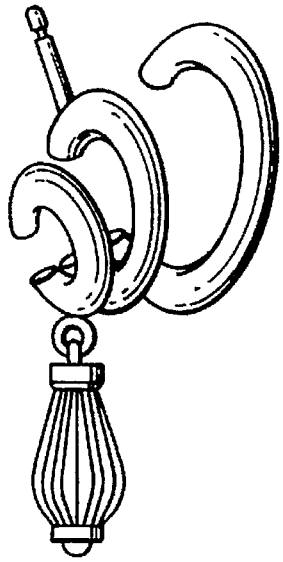
FIG. 7 is a perspective view of the embodiment of FIG. 6.
Figure 8:
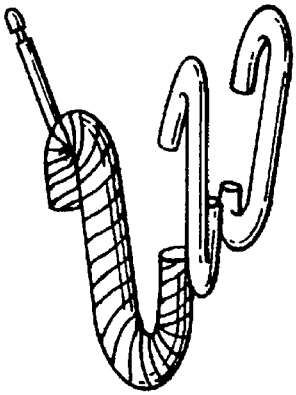
FIG. 8 is a view similar to FIG. 7 but of the embodiment shown in FIG. 9.
Figure 9:
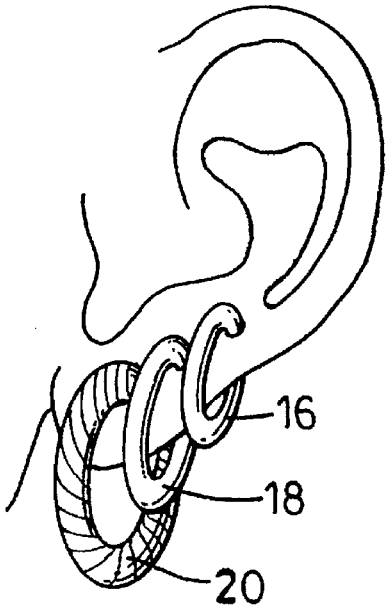
FIG. 9 is a view similar to FIG. 1 of a still further embodiment of the invention.
Figure 10:
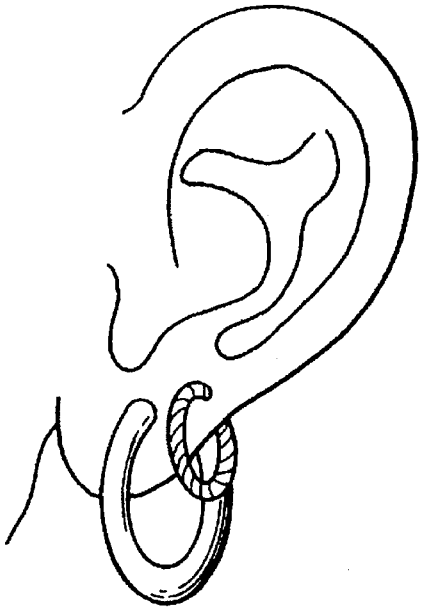
FIG. 10 is a view similar to FIG. 1 of a still further embodiment of the invention.
Figure 11:
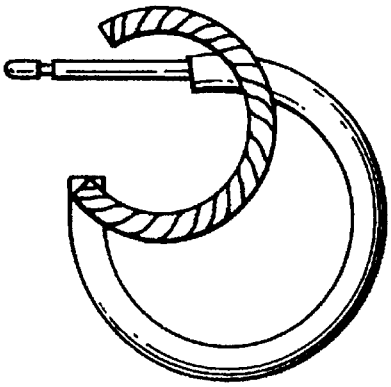
FIG. 11 is a side elevational view of the embodiment of FIG. 10.
Figure 12:
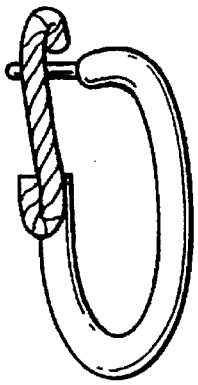
FIG. 12 is a rear elevational view of the embodiment of FIG. 10.

The second ends 43 are attached to each other, for example, using solder. The loops may be shaped so that they are bent toward each other on the inner surface of the ear where they may be connected by a fixture, such as a plate, (shown, for example, at 54 in FIG. 4). In this way the open loops are parallel to each other around most of their length and only bend toward each other at their opposite ends to be connected to each other as best shown in FIGS. 7, 8 and 12, for example.

Again it is essential that the opposite ends of the loops be connected to each other for mutual support so that only one post is necessary and further that they extend to the inner surface of the ear to camouflage the earring structure.

Different open loops as shown in the embodiments of FIGS. 1 and 2 maybe used or the same shaped open loops as in the embodiments of FIGS. 3 and 4. The open loops may be circular, oval polygonal or another open loop shape as long as space is left in the loop construction for receiving the ear and as long as the first ends from each other and lay in a common plane while the second ends are attached to each other and extend into the inner surface of the ear.

While a specific embodiment of the invention has been shown and described in detail to illustrate the application of the principles of the invention, it will be understood that the invention may be embodied otherwise without departing from such principles.

What is claimed:

1. An earring which utilizes a single hole in a pierced ear and appears to be multiple earrings extending through multiple holes in the pierced ear, the earring comprising:

a plurality of elongated, open loops each having a first end and a second end;

the first ends of all of the loops adapted to lie in a common plane corresponding to an outer surface of the pierced ear, the first ends of all the open loops being spaced from each other and extending in a sequence along the outer surface of the ear;

the second ends of all the loops being adjacent each other and being directly connected to each other for mutual support;

each of the loops extending outwardly by increasing amounts from each other, along the lengths of the loops, from the second ends toward the first ends of the loops so that for at least a portion of the lengths of the loop, the loops are not parallel to each other, the loops being shaped so that the second ends extend toward an inner surface of the pierced ear to be hidden by the ear when the earring is worn; and a single post fixed to and extending outwardly from only one of the first ends of the loops, for extending into a single hole of the pierced ear as the sole support for the earring on the ear.

2. An earring according to claim 1, wherein the first ends of all of the open loops are flat.

3. An earring according to claim 1, wherein the first ends of all of the open loops line a straight line.

4. An earring according to claim 3, wherein the first ends of all of the loops are flap.

5. An earring according to claim 1, wherein the open loops are circular.

6. An earring according to claim 1, wherein the open loops are oval.

7. An earring according to claim 1, wherein the open loops are polygonal.

8. An earring according to claim 1, wherein the post is straight.

9. An earring according to claim 1, wherein the post is bent.

10. An earring according to claim 1, wherein the second ends of all the loops are connected to each other by solder.

11. An earring according to claim 1, wherein the second ends of all of the loops are connected to each other by a bar.

12. An earring according to claim 1, wherein each loop extends in an arch of at least 270° between the first and second ends of the open loops.

13. An earring according to claim 12, wherein the second ends of all of the open loops are flat.

14. An earring according to claim 12, wherein the first ends of all of the open loops lie a straight line.

15. An earring according to claim 14, wherein the first ends of all of the loops are flat.

16. An earring according to claim 1, wherein the open loops are parallel to each other up to the second ends of the open loops, and at the second ends, the loops are bent toward each other.

17. An earring which utilizes a single hole in a pierced ear and appears to be multiple earrings extending through multiple holes in the pierced ear, comprising a plurality of elongated open loops each having a first end and a second and, the first ends of all the loops being space from and disconnected from each other and extending in a sequence for lying on an outer surface of the pierced ear, the second ends of the loops being directly connected to each other for mutual support, the loops being shaped so that each of the loops extends outwardly by increasing amounts from each other, along the lengths of the loops, from the second ends toward the first ends of the loops so that for at least a portion of the lengths of the loops, the loops are not parallel to each other, the second ends extending toward an inner surface of the ear to be hidden by the ear when the earring is worn, and a single post fixed to and extending outwardly from only one of the first ends, for extending into the single hole of the pierced ear as the sole support for the earring on the ear.

18. An earring according to claim 17 wherein all of the first ends of the loops lie in a common plane.

19. An earring according to claim 17 wherein all of the loops are connected to each other only at the second ends.

* * * * *